United States Patent [19]

Gilliard et al.

[11] Patent Number: 4,798,995

[45] Date of Patent: Jan. 17, 1989

[54] METAL HALIDE LAMP CONTAINING HALIDE COMPOSITION TO CONTROL ARC TUBE PERFORMANCE

[75] Inventors: Richard P. Gilliard, Mayfield Heights; Daniel M. Cap, Kirtland; Timothy D. Russell, Parma, all of Ohio

[73] Assignee: General Electric Company, Schenectady, N.Y.

[21] Appl. No.: 915,370

[22] Filed: Oct. 6, 1986

[51] Int. Cl.[4] ..... H01J 17/20; H01J 61/22

[52] U.S. Cl. ..... 313/638; 313/490; 313/562; 313/633; 313/630; 313/640; 313/40; 313/44; 313/635

[58] Field of Search ..... 313/25, 490, 489, 637, 313/638, 639, 217, 229, 344, 218, 630, 633, 635, 562, 40, 44

[56] References Cited

U.S. PATENT DOCUMENTS

| | | | |
|---|---|---|---|
| 2,103,038 | 12/1937 | Moers | 313/639 |
| 3,407,327 | 10/1968 | Koury et al. | 313/639 |
| 3,845,342 | 10/1974 | Waymouth et al. | 313/639 |
| 3,937,996 | 2/1976 | Cap | 313/623 |
| 4,199,701 | 4/1980 | Bhattacharya | 313/25 |
| 4,340,836 | 7/1982 | Bergman et al. | 313/639 |
| 4,439,711 | 3/1984 | Murakami et al. | 313/639 |
| 4,463,277 | 7/1984 | Decaro | 313/25 |
| 4,499,396 | 2/1985 | Fohl et al. | 313/25 |
| 4,581,557 | 4/1986 | Johnson | 313/25 |
| 4,591,752 | 5/1986 | Thouret et al. | 313/25 |

*Primary Examiner*—David K. Moore
*Assistant Examiner*—Mark R. Powell
*Attorney, Agent, or Firm*—Philip L. Schlamp; Nathan D. Herkamp; Edward M. Corcoran

[57] ABSTRACT

In an arc tube for a high intensity metal halide discharge lamp, a particular composition of metal halide dose is provided to control thorium transport to the electrodes within the arc tube and tungsten transport to the wall to improve arc tube performance.

8 Claims, 1 Drawing Sheet

Fig. 1
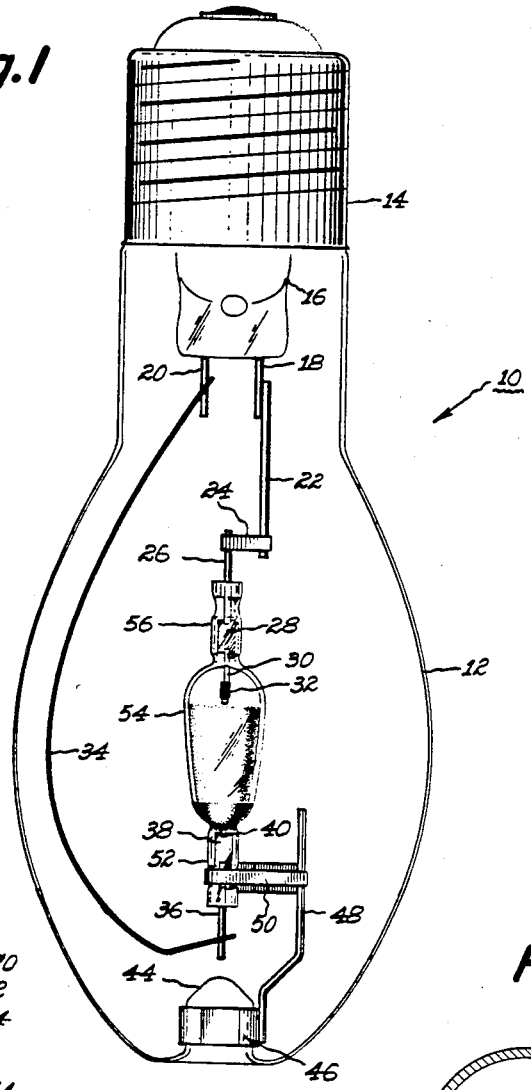
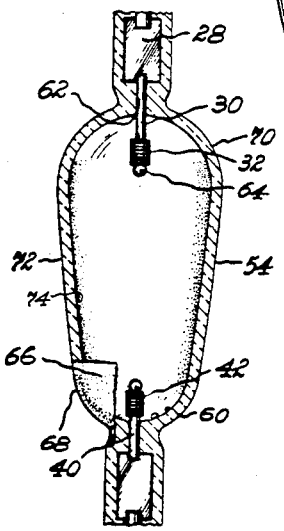
Fig. 2
Fig. 3
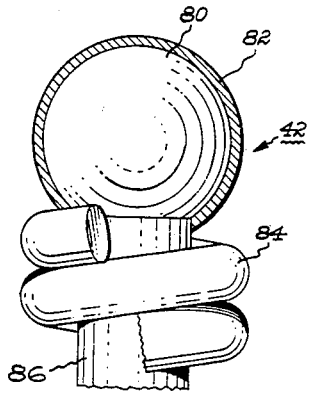

METAL HALIDE LAMP CONTAINING HALIDE COMPOSITION TO CONTROL ARC TUBE PERFORMANCE

BACKGROUND OF THE INVENTION

1. Field of the Invention

The present invention relates to high intensity discharge lamps of the metal halide type and, in particular, to a high intensity discharge lamp containing a combination of metal halides including a particular range of concentrations of thorium iodide to control thorium transport to the electrode tips within the arc tube of the lamp to improve arc tube performance.

2. Description of the Prior Art

Metal halide arc discharge lamps utilize the addition of halides of various light emitting metals to mercury in the arc tube of a high pressure discharge lamp in order to modify the color temperature of the light emitted by the lamp and to raise the operating efficacy of the light output by the lamp as described in U.S. Pat. No. 3,234,421 issued Feb. 8, 1966 to Reiling and assigned to the assignee of the present invention. The electrodes of prior art metal halide lamps typically comprise a thorium tungsten electrode formed by wrapping a tungsten coil to serve as a heat radiator around a tungsten rod with a thorium or thorium oxide containing compound in the turns of the coil. Under proper conditions when operating in a thorium iodide containing atmosphere the tungsten rod acquires a thorium spot on its distal end which serves as a good electron emitter and which is continually renewed by a transport cycle involving the halogen present in the atmosphere which returns to the cathode any thorium lost by any process. The thorium tungsten electrode and its method of operation are described in *Electric Discharge Lamps* by John F. Waymouth, MIT Press, 1971 Chapter 9. Waymouth describes an analysis of the operation of the lamp electrodes in the presence of thorium as producing a coating on the tip of the lamp electrodes. When the electrode is not coated by thorium, the work function of the electrode is higher due to exposure of the tungsten and the resultant direct contact between the arc and the tungsten requiring the electrode to run hotter in order to sustain the arc current which causes poorer lumen maintenance especially in smaller sized lamps. The higher temperature makes the arc tube blacken due to tungsten loss from the electrodes which results in poor lumen maintenance. In a prior art U.S. Pat. No. 4,360,756, issued Nov. 23, 1982 to Spencer et al and assigned to the present assignee, a composition of fill materials is described and claimed which results in a reduction of the free iodine within the arc tube in the arc tube atmosphere during lamp operation to maintain a layer of thorium on the electrode tip during operation. Spencer et al describe the addition of getters (e.g. cadmium and zinc) to limit the build-up of iodine within the arc tube and thereby provide an enhancement of the thorium transport cycle.

SUMMARY OF THE INVENTION

An object of the present invention is to provide a high intensity discharge lamp exhibiting improved lumen maintenance and lamp life. A more particular object of the present invention is to provide a specific dose of thorium iodide in the arc tube of a high intensity lamp such that throughout the normal operating cycle of a high intensity metal halide discharge lamp tungsten loss from the electrode is suppressed.

Accordingly, the present invention in a preferred embodiment includes a fill composition for the arc tube of a high intensity metal halide lamp which includes a quantity of thorium iodide sufficient to ensure the presence of thorium metal or thorium iodide upon the arc electrode surfaces to block tungsten transport therefrom for as long as possible during lamp life. In a particularly preferred embodiment of the present invention the fill composition includes approximately 3.8 percent by weight of thorium iodide ($ThI_4$) or approximately 0.9 milligrams of thorium iodide ($ThI_4$) per ampere of arc current.

BRIEF DESCRIPTION OF THE DRAWINGS

Further objects and advantages of the present invention together with its organization, method of operation and best mode contemplated may best be understood by reference to the following description taken in conjunction with the accompanying drawings, in which like references characters refer to like elements throughout, and in which:

FIG. 1 is a schematic elevation view of a high intensity metal halide discharge lamp incorporating the present invention;

FIG. 2 is a schematic partial cross-sectional elevational view of an arc chamber of the lamp illustrated in FIG. 1; and FIG. 3 is a schematic enlarged elevational view of an arc electrode of the present invention.

DESCRIPTION OF THE PREFERRED EMBODIMENTS

A high intensity metal halide discharge lamp 10 as illustrated schematically in FIG. 1 includes an outer envelope 12 of vitreous material, such as glass having a suitable composition for a high intensity discharge lamp, and a base 14 having suitable electrical contacts for making electrical connection to a conventional threaded socket. The space within the outer envelope 12 may be evacuated or filled with nitrogen gas to a pressure of about 0.5 atmosphere. The end cap 14 surrounds the stem 16 of the lamp through which electrically conductive terminal wires 18 and 20 extend. Terminal wire 18 is connected to support rod 22 to which support member 24 is attached. An electrically conductive inlead 26 connected to support member 24 on one end is connected to foil member 28 which is connected to electrode stem 30 of the electrode 32. A support lead 34 is connected to terminal 20 and is connected directly to inlead 36 which is connected to the foil member 38 connected to electrode stem 40 of electrode 42. An anchoring dimple 44 is provided at the bottom end of the outer envelope 12 so that a metallic collar 46 may be disposed thereon to support rod 48 connected by support member 50 to the stem 52 of the arc tube 54. The stems 52 and 56 of the arc tube are sealed around the ribbon members 28 and 30 to seal the interior of the arc tube.

The arc tube 54 shown in more detail in FIG. 2 includes an inner envelope of vitreous material such as thin walled fused silica sealed at the respective ends as described above with the electrodes 32 and 42 projecting into the interior from the respective ends thereof. In the arc tube 54 shown in FIG. 2 the arc tube envelope includes a generally hemispherical end 60 having a predetermined radius and a generally hemispherical end 70 having a radius larger than the radius of end 60 and joined thereto by a tapered wall 72 having the shape of a generally circular arc of revolution. Although only the asymmetrical arc tube is shown it is to be understood that the present invention applies equally well to lamps having arc tubes with a circular cylindrical geometry with the radius generally constant along the arc tube longitudinal axis. A suitable filling is disposed within the arc chamber 54 to provide an arc carrying medium during operation of the lamp. The electrode stem 30 is sealed at 62 into the arc tube end and the stem 40 is similarly sealed into the opposite arc tube end. The tungsten wire electrodes 32 and 42 are wrapped into the form shown in FIG. 2 and project into the interior of the arc chamber by a predetermined distance so that the vaporization of fill materials is maintained at the appropriate level during lamp operation. The electrode 42 is shown greatly enlarged in FIG. 3, and it is to be understood that both electrodes 32 and 42 in the arc tube are constructed and operate similarly. The tip 80 of the tungsten electrode is coated by a layer 82 of thorium. The coil 84 of tungsten surrounds the rod 86 of the electrode 42 and serves to radiate heat and cool the electrode. An infrared reflective coating 66 may be disposed upon the exterior surface 68 of one end 60 of the arc tube 54 to assist in maintaining the fill materials in the vapor state during lamp operation.

The present invention involves maintaining the vaporization rate of thorium iodide at the wall of the arc tube so as to ensure the presence of the thorium metal layer 82 on the surface of the electrode tip 80 for as long as possible during lamp operation in order to ensure against loss of tungsten from the electrode surface. A similar layer of thorium is maintained on electrode tip 64. The electrode is made of tungsten and thorium metal or thorium oxide ($ThO_2$) and the metal halide dose includes a quantity of thorium tetraiodide ($ThI_4$) During operation of the lamp the metal halides including the thorium tetraiodide vaporize in the arc and condense on the interior surface of the arc tube walls to form a film, shown by stippling 74. The amount of coverage of the interior wall surface of the arc tube depends upon the amount of fill material within the arc tube that can be vaporized during operation of the discharge lamp and the arc tube geometry. The composition of the fill determines the materials in the condensate which coat the interior of the arc tube walls. The fill normally includes an amalgam of mercury, for example, of an about 0 to about 5 molar percent cadmium amalgam, and a quantity of metal halides normally a combination of iodides including, for example, sodium iodide, scandium iodide and thorium iodide in predetermined weight percents, plus an inert gas fill as a starting gas. The total quantity of the metal halides is selected to provide an excess of halides above the amount which is vaporized during normal operation of the lamp, so that some of the metal halides will condense upon the interior surface of the arc tube wall.

During normal lamp operation a transport cycle exists between the thorium tetraiodide, $ThI_4$, on the arc tube walls and the thorium metal or thorium oxide $ThO_2$ which is part of the lamp electrodes. If sufficient thorium tetraiodide is deposited upon the arc tube walls, some will be continuously vaporized and provide a source for deposition of thorium metal upon the lamp electrodes to maintain a coating of thorium upon the tungsten electrodes. Activation of the transport cycle requires a vaporization rate from the electrode tip of thorium metal or $ThI_X (X<4)$ to be less than the vaporization rate of thorium tetraiodide $ThI_4$ at the walls. The present invention involves maintaining the vaporization rate of thorium tetraiodide, $ThI_4$, at the wall greater than the rate of thorium removal at the electrode during lamp life, particularly in the presence of iodine buildup due to inevitable metal loss and reaction in the arc tube throughout lamp life, thereby decreasing the rate of tungsten loss from the electrode. Lumen maintenance improvement is obtained by adding a specified amount of $ThI_4$ to the metal halide dose in order to promote physical and chemical mechanisms which result in larger than conventional amounts of thorium being deposited on both electrodes during lamp life. When the amount of thorium tetraiodide per ampere of arc current is about 0.9 mg/amp, substantial improvements in lumen maintenance are realized over arc tubes having $ThI_4$ concentration of about 0.4 mg/amp. Lumen maintenance improvement is observed to level off as $ThI_4$ concentration increases to the range of about 1.0 mg/amp to about 1.5 mg/amp for arc tubes with approximately equal total amounts of metal halide dose. The amount of thorium dose in the lamp affects lumen maintenance either because the presence of bulk thorium as opposed to only a monolayer further suppresses tungsten loss, and/or because some of the thorium initially reacts with inevitable arc tube impurities. In either case the more thorium present in the arc tube available for transport, the greater the likelihood of a sufficient amount being transported to the electrode tip to ensure bulk deposition or at least a coating layer 82 of thorium being present on the electrode. The amount of thorium transported is determined by the vapor pressure of thorium at the arc tube wall, which in turn is determined by the surface temperature of the condensate on the arc tube wall as well as the composition of the condensate.

Increasing the relative concentration of $ThI_4$ in the metal halide dose tends to raise the $ThI_4$ vaporization rate at the wall and favor transport of thorium to the electrode, until iodine buildup over time from loss or reaction of other lamp metals (e.g. sodium and scandium) suppresses thorium condensation on the electrode. Increasing the total amount of metal halide dose ensures that there is sufficient condensate to fill small crevices and other cold parts of the arc tube and still provide sufficient condensate to ensure that wall coverage will be non-localized extending over the inner surface of the arc tube wall up to the point of the upper electrode in the case of appropriate arc tube geometries. Complete coverage of the arc tube wall with metal halide condensate prevents deposition of tungsten compounds upon the arc tube and the resultant wall darkening. Excess dose also ensures that sufficient thorium tetraiodide is present on the walls to sustain the thorium transport cycle and maintain a coating of thorium on the lamp electrode. The presence of thorium on the electrode tip reduces tungsten loss by acting as a barrier and/or by lowering the electrode tip temperature as a result of the lowered work function. High wall coverage of condensate serves as a reservoir of thorium at the top of the arc tube to increase thorium concentration near the top electrode to improve thorium coating on the top electrode during lamp operation. We have found that a metal halide dose containing a quantity of thorium tetraiodide $ThI_4$ in the range from about 3.8 percent by weight up to an apparent saturation limit of about 6.0 percent by weight of metal halide dose improves lumen maintenance irrespective of other lamp design factors over a $ThI_4$ concentration of about 1.8 percent. At concentration above the saturation limit an undesireable chemical reaction may result between thorium and other arc tube materials or chemicals. For metal halide discharge lamps in the range of about 30 watts to about 1000 watts which operate with arc current in the range of about 0.5 ampere to about 3.5 amperes and voltage levels of about 80 to about 270 volts, use of a metal halide dose having a sufficient quantity of $ThI_4$ to provide a ratio of amount of $ThI_4$ to lamp arc current in the range of about 0.9 mg/amp to about 1.5 mg/amp maintain the thorium transport cycle and thereby improve lamp lumen maintenance.

In a specific experiment a metal halide dose composition containing sodium iodide (NaI) about 85.1 percent by weight, scandium iodide ($ScI_3$) about 11.1 percent by weight and thorium iodide ($ThI_4$) about 3.8 percent by weight provided significantly improved lumen maintenance using standard electrodes in a high intensity metal halide discharge lamp when compared with a dose containing about 85.9% NaI, 12.3% $ScI_3$, and 1.8% $ThI_4$. A test was conducted to compare 80 and 100 watt metal halide lamps having a $ThI_4$ concentration in the metal halide dose of about 3.8 percent by weight with similar lamps having a $ThI_4$ concentration of about 1.8% by weight. After 2000 hours of continuous burning the lamps having a $ThI_4$ concentration of 3.8 percent showed a lumen maintenance about 11.3% higher than the lamps having the lower $ThI_4$ concentration, in a factorial experiment with a variety of factors including a comparison of lumen maintenance versus $ThI_4$ concentration. A similar experiment was conducted using 125 watt metal halide lamps operated for 3000 hours with one third of the lamps burned continuously for 3000 hours and two thirds of the lamps operated on a schedule of eleven hours on and one hour off for a total time of 3000 hours. The 125 watt lamps having a $ThI_4$ concentration of about 3.8 percent by weight or about 0.9 milligrams per ampere of arc current showed an average lumen maintenance advantage at 3000 hours of about 12.6% over the lamps having a $ThI_4$ concentration of about 1.8 percent by weight or about 0.4 milligrams per ampere.

From the above description of the present invention those skilled in the art will recognize that a substantial improvement in metal halide discharge lamp lumen maintenance has been achieved as a result of the present invention which recognizes and utilizes various factors of metal halide lamp design to enhance the thorium transport cycle.

What we claim is new and desire to secure by a letters patent of the United States is:

1. A high intensity metal halide discharge lamp comprising:

an hermetically sealed vitreous light transmissive outer envelope;

first and second electrical terminal means secured into said outer envelope for making electrical connection from an external power source to the interior of said outer envelope;

first and second conductive lead means for making connection to respective ones of said terminal means;

an hermetically sealed sealed light transmissive vitreous arc tube envelope having respective first and second ends disposed within said outer envelope;

first and second electrodes comprising tungsten and thorium or thorium oxide disposed within said arc tube envelope and sealed into said first and second respective ends of said arc tube envelope;

first and second inlead means for passing through respective arc tube stems at said respective ends of said arc tube envelope and for connecting respective ones of said conductive lead means to respective ones of said first and second electrode means;

support means for supporting said arc tube envelope in a predetermined orientation relative to said outer envelope;

a discharge supporting medium disposed within said arc tube envelope and comprising a quantity of an amalgam of mercury containing 0 to 5 molar percent cadmium;

a quantity of an inert fill gas in said arc tube as a starting gas, and a metal halide dose comprising a combination of metal halides, including thorium tetraiodide, present in said arc tube in an amount in excess of that amount vaporized during normal operation of the lamp wherein the amount of thorium tetraiodide present in the dose ranges from about 3.8 to 6.0 wt. % thereof and from about 0.9 to 1.5 milligrams per ampere of arc current to maintain a coating of thorium on at least the end portion or tip of said electrodes.

2. The lamp of claim 1 wherein said metal halide dose comprises a mixture thorium tetraiodide, sodium iodide and scandium iodide.

3. The invention of claim 2 wherein said lamp comprises a metal halide discharge lamp for operating from an a-c power supply providing a lamp operating voltage in the range of about 80 to about 270 volts.

4. The lamp of claim 2 wherein said metal halide dose consists essentially of about 85.1 percent by weight sodium iodide, about 11.1 percent by weight scandium iodide and about 3.8 percent by weight thorium tetraiodide.

5. An arc tube for a high intensity metal halide discharge lamp comprising:

an hermetically sealed light transmissive vitreous arc tube envelope having respective first and second ends;

first and second electrodes comprising tungsten and thorium or thorium oxide sealed into said respective first and second ends of said arc tube envelope;

first and second inlead means for passing through respective arc tube stems at the respective ends of said arc tube envelope and for connecting respective ones of said first and second electrode means to a source of electrical power;

a discharge supporting medium disposed within said arc tube envelope and comprising a quantity of a mercury amalgam which may contain up to about 5 molar percent cadmium;

a quantity of an inert fill gas in said arc tube as a starting gas; and a metal halide dose comprising a combination of metal halides, including thorium tetraiodide, present in said arc tube in an amount in excess of that amount vaporized during normal operation of the arc wherein the amount of thorium tetraiodide present in the dose ranges from about 3.8 to 6.0 wt. % thereof and from about 0.9 to 1.5 milligrams per ampere of arc current to maintain a coating of thorium on at least the end portion or tip of said electrodes.

6. The arc tube of claim 5 wherein said metal halide dose comprises a mixture of thorium tetraiodide, sodium iodide and scandium iodide.

7. The invention of claim 6 wherein said arc tube comprises an are tube for operating from an a-c power supply providing an operating voltage in the range of about 80 to about 270 volts.

8. The arc tube of claim 6 wherein said metal halide dose consists essentially of about 85.1 percent by weight sodium iodide, about 11.1 percent by weight scandium iodide and about 3.8 percent by weight thorium tetraiodide.

* * * * *